US006562768B1

(12) United States Patent
Gregston

(10) Patent No.: US 6,562,768 B1
(45) Date of Patent: May 13, 2003

(54) COMPOSITION FOR AND METHOD OF CUTTING INTERNAL THREADS ON THE SURFACE OF A HOLE IN A WORKPIECE

(76) Inventor: Ronnie L. Gregston, 801 S. Seventh, Marlow, OK (US) 73055

( * ) Notice: Subject to any disclaimer, the term of this patent is extended or adjusted under 35 U.S.C. 154(b) by 168 days.

(21) Appl. No.: 09/928,567

(22) Filed: Aug. 13, 2001

(51) Int. Cl.[7] ..... C10M 161/00
(52) U.S. Cl. ..... 508/489; 508/491; 72/42
(58) Field of Search ..... 508/486, 489, 508/491; 72/42

(56) References Cited

U.S. PATENT DOCUMENTS

| | | | | |
|---|---|---|---|---|
| 3,600,310 A | | 8/1971 | Eyres et al. | 252/48.6 |
| 3,896,038 A | | 7/1975 | Hartle | 252/51.5 |
| 3,898,169 A | * | 8/1975 | Kretzinger et al. | 508/489 |
| 3,928,214 A | * | 12/1975 | Naka et al. | 508/489 |
| 4,038,088 A | | 7/1977 | White et al. | 106/38.24 |
| 4,072,618 A | | 2/1978 | Andress | 252/46.6 |
| 4,108,785 A | | 8/1978 | Sturwold | 252/56 R |
| 4,559,153 A | | 12/1985 | Baldwin et al. | 252/48.6 |
| 4,654,155 A | | 3/1987 | Kipp et al. | 252/32.5 |
| 4,758,359 A | | 7/1988 | Kirk et al. | 252/32.5 |
| 4,759,861 A | | 7/1988 | Ogura et al. | 252/33 |
| 4,761,241 A | | 8/1988 | Kobori et al. | 252/32.5 |
| 4,783,274 A | | 11/1988 | Jokinen et al. | 252/32.7 E |
| 4,828,737 A | | 5/1989 | Sandberg et al. | 252/49.3 |
| 4,978,465 A | | 12/1990 | Sturwold | 252/48.4 |
| 5,282,989 A | | 2/1994 | Erickson et al. | 252/48.2 |
| 5,399,274 A | | 3/1995 | Marcus | 252/49.3 |
| 5,569,406 A | | 10/1996 | Barnhorst et al. | 508/431 |
| 5,744,432 A | | 4/1998 | Barnhorst et al. | 508/431 |
| 5,837,658 A | | 11/1998 | Stork | 508/421 |
| 5,916,854 A | | 6/1999 | Inaya et al. | 508/452 |
| 6,127,326 A | * | 10/2000 | Dieckmann et al. | 508/491 |

* cited by examiner

*Primary Examiner*—Jacqueline V. Howard
(74) *Attorney, Agent, or Firm*—Thomas R. Weaver

(57) ABSTRACT

This invention provides a tapping composition, a method of making the tapping composition and a method of using the tapping composition to cut internal threads on the surface of a hole drilled in metal. The tapping composition of this invention is comprised of a uniform blend of a glyceride, a liquid hydrocarbon oil and a polyvinyl chloride resin.

25 Claims, 1 Drawing Sheet

Figure 1:
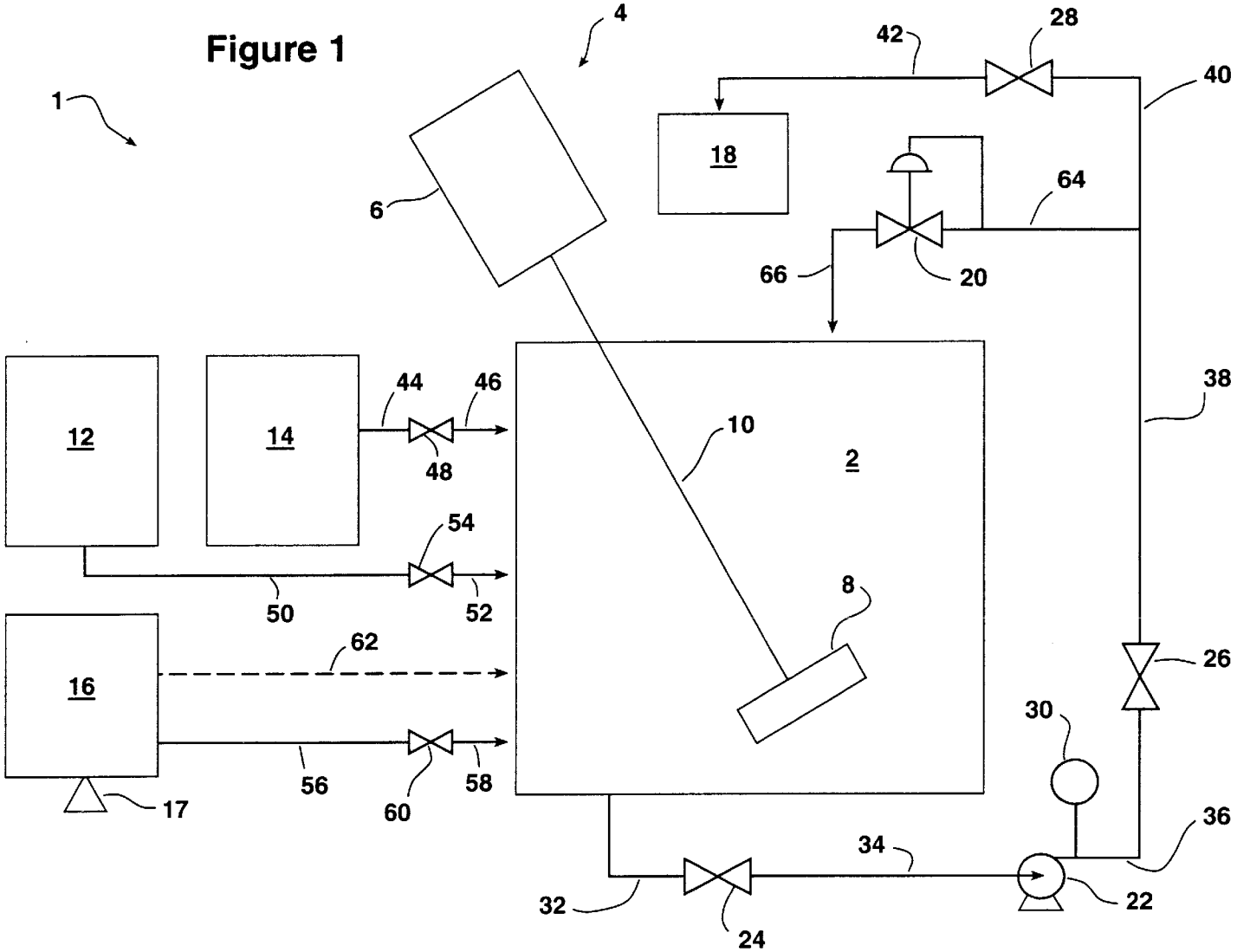

COMPOSITION FOR AND METHOD OF CUTTING INTERNAL THREADS ON THE SURFACE OF A HOLE IN A WORKPIECE

BACKGROUND OF THE INVENTION

1. Technical Field of the Invention

This invention broadly relates to machining a workpiece. The invention more particularly relates to cutting threads on a workpiece. The invention still more particularly relates to a method for cutting internal threads on the surface of a hole drilled in metal. The invention specifically relates to a tapping composition and to a method of using the composition to make internal threads on the surface of a hole drilled in metal.

2. Description of the Prior Art and Problems Solved

It is known that "tapping" is a method employed in the machining art for cutting internal threads in a workpiece, such as a metal body. Tapping is, thus, broadly comprised of the steps of drilling a hole of desired diameter in a metal body; selecting a solid linear article, i.e., a tap, having a circular cross section and desired grooves formed on the exterior surface of the tap, wherein the outside diameter of the grooves on the tap is greater than the diameter of the hole drilled in the metal body; rotating the selected tap; and inserting the rotating tap into the previously drilled hole whereby the grooves on the tap contact and cut into the sides of the hole in the metal body to thereby produce the desired internal threads.

Contact between the grooves of the rotating tap and the sides of the hole is accompanied by the generation of frictional heat. This heat, if not properly handled, can result in the production of threads having undesirable quality, possible damage to the metal body, damage to the tap and shortened tap life. The art has sought methods for preventing or dissipating the mentioned frictional heat to avoid, or at least to reduce, the problems caused by such heat.

The art has, accordingly, developed various compositions, referred to as lubricants, to aid in the performance of the tapping process, wherein a lubricant is placed on the tap grooves prior to the insertion of the tap into the hole to be tapped. The purpose of the lubricant is to reduce frictional resistance between the rotating tap and the wall of the hole to help reduce the generation of frictional heat and to dissipate heat generated during the process.

It is believed that existing tapping lubricants tend to develop undesirably low viscosity during the tapping process and tend to drain away from the tap and, thus, cease to function as desired to reduce friction and dissipate heat. As a result, thread quality is low and tap life is unacceptably shortened. A method of measuring tap life is the number of holes which can be threaded with the same tap.

It is obvious that a quantity of power is required to cause a tap to rotate in a hole in order to cut threads. In this regard, it has been observed that the higher the power required to produce threads the lower the tap life. Skilled operators take as a signal that a new tap is required when the power required to tap a hole approaches a certain value. Thus, in order to save power, to produce threads of acceptable quality and to avoid tap failure, skilled operators know to change taps when the mentioned power threshold is approached.

It is thus an object of this invention to provide a tapping composition which can be employed in a tapping process to increase tap life, to produce threads of acceptable quality, and to conserve power.

The Invention

1. DISCLOSURE OF THE INVENTION

This invention comprises a tapping composition, a method of making the composition and a method of using the composition to make internal threads on the surface of a hole drilled in a workpiece, such as a flat metal plate or a metal block. The tapping composition of this invention is comprised of a uniform blend of a glyceride, a liquid hydrocarbon oil and a polyvinyl chloride resin. A process of making the tapping composition of this invention is disclosed and, in one aspect, the composition is the product of that process.

It has been observed that use of the tapping composition of this invention to cut threads has required the expenditure of power in an amount less than that required to cut threads with identical taps under identical conditions when employing lubricants known in the prior art. This observation has been confirmed by an observed increase in tap life. Without being bound by a particular theory of operation, it is believed that the composition of this invention, due to the generation of heat, forms a film on the tap and that the film does not drain away from the essential points of contact between the grooves of the tap and the wall of the hole.

2. BRIEF DESCRIPTION OF THE DRAWINGS

FIG. 1 is a schematic diagram of a flow path and related equipment which can be employed in a process for making the tapping composition of this invention.

3. DESCRIPTION OF THE PREFERRED EMBODIMENTS

Referring to FIG. 1, process system 1 comprises mixing tank 2, mixer 4, comprised of motor 6, impeller 8 and impeller shaft 10, oil source tank 12, polyvinyl chloride source tank 14, glyceride supply source 16, product tank 18, control valve 20, pump 22, circulation valves 24 and 26, product valve 28 and pressure gauge 30. Process system 1, in another embodiment, can also include heater 17.

Mixing tank 2 is connected to product tank 18 by circulation lines 32, 34, 36 and 38, product lines 40 and 42, circulation valves 24 and 26, product valve 28 and pump 22.

Polyvinyl chloride source tank 14 is connected to mixing tank 2 by feed lines 44 and 46 and valve 48. Oil source tank 12 is connected to mixing tank 2 by feed lines 50 and 52 and valve 54.

Glyceride supply source 16 is connected to mixing tank 2, in one embodiment, by feed lines 56 and 58 and valve 60, or, in another embodiment, by flow path 62.

As shown, impeller 8 is connected to motor 6 by shaft 10, wherein impeller 8 is placed within the-interior of tank 2 to agitate the contents of tank 2 to cause the intimate physical blending of the contents of tank 2. Shaft 10 is preferably positioned at an acute angle with respect to the bottom of tank 2, and impeller 8 is preferably positioned in the lower portion of tank 2 adjacent the bottom thereof.

The bottom of mixing tank 2 is in exterior communication with the top of tank 2 to enable the circulation of and to aid in the blending of the contents of tank 2. The mentioned exterior communication is accomplished by the combination of circulation lines 32, 34, 36, 38, 64 and 66, circulation valves 24 and 26, control valve 20 and pump 22. Circulation line 32 is preferably positioned to enable withdrawal of liquid from tank 2 at a point vertically below impeller 8. Circulation line 66 is preferably positioned to enable introduction of liquid into tank 2 at a point vertically above impeller 8 and substantially diametrically opposed to the point of withdrawal of liquid from tank 2 via line 32.

The finished tapping composition can exhibit a viscosity greater than that of water and can present difficult pumping properties. Accordingly, pump 22 is, preferably, a positive displacement pump.

In another embodiment, heater 17 is employed to heat the contents of source 16.

4. OPERATION OF THE INVENTION

To prepare the tapping composition of this invention, a liquid hydrocarbon oil from tank 12, in an amount required to prepare a given batch of tapping composition, is introduced into mixing tank 2 via valve 54 and lines 50 and 52. When the required quantity of oil has been introduced into tank 2, valve 54 is closed and agitation of the contents of tank 2 is established by activating motor 6 to rotate impeller 8. Thereafter, circulation of the contents of tank 2 is established by closing product valve 28, opening circulation valves 24 and 26, opening control valve 20 and activating pump 22. By these steps, the quantity of oil required to make a batch of product is introduced into the mixing tank and blending and circulation is established.

It is believed that the oil component of the tapping composition of this invention functions to establish and regulate the viscosity of the composition. It is, accordingly, preferred that the oil be present in the tapping composition in an amount in the range of from about 20 to about 30 pounds oil per 100 pounds of tapping composition.

In a preferred embodiment, the hydrocarbon oil employed is API GL-6 gear oil having SAE viscosity 85W-140. One such oil is identified by the brand name MYSTIK JT-7 MULTI-PURPOSE GEAR LUBRICANT 85W-140 which is currently available from CATO Oil and Grease Company of Oklahoma City, Okla. The mentioned gear oil is preferably employed in tank 2 at a temperature in the range of from about 85° F. to about 100° F.

To obtain desirable blending of the contents of tank 2 and to avoid foaming, it is preferred that motor 6 operate to rotate impeller 8 at a rate of about 3450 RPM. In addition, impeller 8 is preferably a flat plate 4 inches long and 1 inch wide having about a 10° pitch on each side of shaft 10. It is still further preferred (to obtain desirable blending of the contents of tank 2 and to avoid foaming) that pump 22 operate to produce a flow rate in line 36 of about 10 gallons per minute and to produce a pressure of 20 psig in line 36 downstream of pump 22 at gauge 30.

Thereafter, solid, finely divided, separate particles of polyvinyl chloride, in an amount sufficient to prepare a given batch of composition, is introduced into mixing tank 2 from tank 14 via valve 48 and lines 44 and 46. It is preferred that the particulate polyvinyl chloride be dispersed in a liquid carrier. When the entire required quantity of polyvinyl chloride has been introduced into tank 2, valve 48 is closed and agitation and circulation of the contents of tank 2, as described above, is continued until the oil and polyvinyl chloride in tank 2 are thoroughly blended. It is believed that blending is complete when the contents of tank 2 appear upon observation to be uniform in appearance and consistency.

The particle size of the finely divided polyvinyl chloride preferred for use herein is in the range of from about 5 to about 10 microns.

The weight ratio of finely divided polyvinyl chloride to hydrocarbon oil introduced into tank 2, and, thus, the weight ratio of these constituents in the completed tapping composition, is an amount in the range of from about 1 to about 2.5, preferably from about 1.25 to about 2, still more preferably from about 1.35 to about 1.92 and most preferably about 1.54 parts by weight of finely divided polyvinyl chloride per 1 part by weight of hydrocarbon oil.

It was previously mentioned that the finely divided polyvinyl chloride introduced into tank 2 is preferably dispersed in a liquid carrier. Accordingly, the polyvinyl chloride content of tank 14 is preferably a dispersion comprised of polyvinyl chloride in a liquid plasticizer for polyvinyl chloride. One such plasticizer is an ester of phthalic acid (a phthalate). Accordingly, a material preferred for use herein is a dispersion consisting of 100 pounds of 5 to 10 micron polyvinyl chloride in 30 pounds of phthalate plasticizer. A material meeting that description is currently commercially available from Tumwell, Inc., of Mineral Wells, Tex., under the name Plastisol T-004. The concentration of polyvinyl chloride previously mentioned can be obtained by combining the mentioned commercial dispersion with hydrocarbon oil in tank 2 in an amount in the range of from about 1.3 to about 3.25, preferably from about 1.625 to about 2.6, still more preferably from about 1.75 to about 2.5 and most preferably about 2 parts by weight of the mentioned polyvinyl chloride dispersion per 1 part by weight of hydrocarbon oil. It is believed that the desired uniform blend of dispersed polyvinyl chloride and hydrocarbon oil can be obtained after about 15 minutes of agitation and circulation as described above.

The glyceride component of the tapping composition of this invention is then added to the uniform blend of oil and finely divided polyvinyl chloride in tank 2. The glyceride can be employed in the form of a solid or a liquid and can be either a purified animal fat or a vegetable oil. If the glyceride is employed as a solid, then circulation of the contents of tank 2 by operation of pump 22 is discontinued pending addition of all of the glyceride component, but agitation of the contents of tank 2 with impeller 8 is continued. When all of the solid glyceride required to make a given batch has been added, then circulation is resumed. If the glyceride is employed as a liquid, then circulation and agitation of the contents of tank 2 is not interrupted. Agitation and circulation of the contents of tank 2 is continued after addition to tank 2 of all glyceride required to make a given batch until the contents of tank 2 is uniform in color, viscosity, density and consistency. At this point the process is complete and the tapping composition of the invention can be defined as the product of the above described process.

The weight ratio of glyceride to hydrocarbon oil introduced into tank 2, and, thus, the weight ratio of these constituents in the completed tapping composition, is an amount in the range of from about 0.5 to about 2, preferably from about 0.75 to about 1.5, still more preferably from about 0.875 to about 1.25 and most preferably about 1 part by weight of glyceride per 1 part by weight of hydrocarbon oil.

As mentioned above, the glyceride employed herein can be a purified animal fat. In this regard, purified animal fat is obtained by the well known process of "rendering," wherein the raw fat of an animal such a hog, a sheep or a cow is melted to recover the purified product. In the case of hogs, the purified product is referred to as lard; in the case of sheep and cattle, the purified product is referred to as tallow. Tallow and lard can be employed in this invention. Lard is preferred.

Purified animal fat is a solid at room temperature and can be used as such herein. Accordingly, if a solid is employed, then circulation of the contents of tank 2 is terminated by discontinuing the operation of pump 22 and closing valves 24 and 26. Then, while continuing the operation of impeller 8, discrete portions of the solid are added to the contents of tank 2 via path 62 until all of the solid required to produce a given batch of product has been introduced into tank 2. A "discrete" portion of solid is that amount which will be sufficiently sheared by the agitation of the contents of tank 2 by impeller 8 to be dispersed in such contents rather than to simply adhere to the blades of impeller 8. Each addition of each discrete portion of solid, which is believed to be about 10 percent of the total amount of solid to be employed in a given batch, is made after a visual examination of tank 2 indicates the contents to be uniformly blended.

When all of the solid has been added to tank 2, circulation, as previously described, is resumed and continued until the thus prepared tapping composition of this invention has attained a uniform consistency and is ready for recovery from tank 2.

If the glyceride employed herein is a liquid, then, while continuing the operation of impeller 8 and pump 22, all of the liquid glyceride required to produce a given batch of product is introduced into tank 2 via valve 60 and lines 56 and 58. Accordingly, if a liquid is employed, then circulation of the contents of tank 2 by operation of pump 22 is not terminated and blending of the contents is continued by operation of impeller 8.

The liquid glyceride can be either a vegetable oil or an animal fat. If an animal fat is employed, then it is first melted in tank 16 by heater 17 at a temperature greater than about ambient and up to about 100° F. before being introduced into tank 2 via lines 56 and 58 and valve 60.

To recover the tapping composition of this invention, agitation and circulation is continued as described and valve 28 is opened to permit a desired quantity of composition to flow via lines 40 and 42 into product tank 18.

The tapping composition of this invention, when prepared as described using the most preferred quantities of the disclosed dispersed polyvinyl chloride, the disclosed gear oil and lard has a density of about 1.255 grams per milliliter and a Brookfield viscosity greater than 4000 cp at 78° F. The composition, which exists in the form of a liquid at temperatures in the range of from about 60 to about 212° F., is non-staining and is believed to be a stable, solid-in-liquid emulsion. The composition has been observed to resist separation upon standing at temperatures in the range of from 60 to 80° F. for a period of at least 6 months.

Taps having a standard diameter are available for cutting internal threads in holes having standard diameters. In this regard, the outside diameter of a tap is greater than the diameter of a hole. The difference in diameters is a function of the size and type of thread to be cut in the hole. Accordingly, a standard diameter hole is first drilled in a workpiece. Thereafter, a tap suited for that hole is selected. The tapping composition of this invention is then placed on the tap by squirting it on the tap or by dipping the tap in a vessel containing the composition. The tap, having the composition placed thereon, is then caused to rotate and then inserted into the hole whereby the grooves on the tap contact the sides of the hole and cut threads thereon.

EXAMPLE 1

Internal threads were cut in a metal block using the tapping composition of this invention. Internal threads were also cut in a metal block using a commercially available tapping fluid. The tapping conditions and operating parameters were identical and are specifically set forth in Table 1, below. The results obtained are set forth in Table 2, below. For convenience, the tapping composition and tapping fluid are referred to as lubricants.

The commercially available tapping fluid employed in the comparison was available from Castrol Industrial North America, Inc., under the trade mark MOLY-DEE.

The specific tapping composition of this invention employed in the comparison was prepared in accordance with the method described in connection with FIG. 1. The composition thus contained 2 parts by weight of a dispersion of polyvinyl chloride in an ester of phthalic acid, 1 part by weight gear oil, and 1 part by weight lard. The polyvinyl chloride employed is identified in the disclosure as PLASTISOL T-004. The gear oil employed is identified in the disclosure as MYSTIK JT-7 MULTI-PURPOSE GEAR LUBRICANT 85W-140.

In operation, a hole was first drilled in a metal block. Thereafter, a quantity of lubricant was squirted into and on the inside surface of the hole and on the tap. The quantity of lubricant employed in the tapping of each hole was held constant.

Thereafter, the tap was caused to rotate and the rotating tap was inserted into the hole to cut internal threads on the walls of the hole.

The machine employed to rotate the tap in the hole was equipped with a gage which measured the horsepower used to turn the tap in the hole as a percent of maximum available power. It was the experience of the machine operator that a tap was in danger of breaking if the load meter registered a value of 12 percent.

TABLE 1

| | Operating Conditions and Parameters | |
|---|---|---|
| Machine, Tap, Metal and Hole Parameters | Composition of Prior Art | Composition of this Invention |
| tap grade | high speed steel | high speed steel |
| tap size | 1 inch diameter, 14 threads per inch, spiral point | 1 inch diameter, 14 threads per inch, spiral point |
| machine description | Mori-Seiki MH-630, computer numerical controlled horizontal machining center, year model 2000 | Mori-Seiki MH-630, computer numerical controlled horizontal machining center, year model 2000 |

TABLE 1-continued

| Operating Conditions and Parameters | | |
|---|---|---|
| Machine, Tap, Metal and Hole Parameters | Composition of Prior Art | Composition of this Invention |
| machine power rating | 50 horsepower | 50 horsepower |
| type of metal tapped | 8-inch thick, forged steel, 4000 ASTM Alloy, 29–36 Rockwell Hardness | 8-inch thick, forged steel, 4000 ASTM Alloy, 29-36 Rockwell Hardness |
| diameter of hole tapped | 0.930 - inch | 0.930 - inch |
| tap rotation rate in hole | 92 revolutions per minute | 92 revolutions per minute |
| tap penetration rate into hole | 0.0714 inches per revolution | 0.0714 inches per revolution |
| tap penetration depth | 1.3 inches | 1.3 inches |

TABLE 2

| Compare Performance of Composition of this Invention with Performance of Composition of Prior Art | | |
|---|---|---|
| Observed Results | Composition of Prior Art | Composition of This Invention |
| number of holes tapped with single tap | 96 | 144 |
| load meter reading | 10% | 7% |
| visual condition of cut threads | dull and rough | smooth and clean |
| hand tapping required to obtain gage | yes | no |

Reference to the contents of Table 2 reveals that the composition of this invention resulted in the ability to cut more threads with a single tap, i.e., longer tap life, and less power to tap each hole. The threads produced with the composition of this invention were "smooth and clean." Furthermore, threads made using the prior art composition failed to gage, i.e., failed to accept a thread plug gage, without first being further tapped by hand. Threads made with the composition of this invention did not require hand tapping to accept the standard gage.

Having described the invention, that which is claimed is:

1. A composition of matter comprising a uniform blend of particulate polyvinyl chloride, a glyceride, selected from the group consisting of rendered animal fat, vegetable oil and mixtures thereof, and a hydrocarbon oil;

wherein the weight ratio of said polyvinyl chloride to said hydrocarbon oil in said composition is an amount in the range of from about 1 to about 2.5 parts by weight of said polyvinyl chloride per 1 part by weight of said hydrocarbon oil;

the weight ratio of said glyceride to said hydrocarbon oil in said composition is an amount in the range of from about 0.5 to about 2 parts by weight of said glyceride per 1 part by weight of said hydrocarbon oil; and said hydrocarbon oil is present in said composition in an amount in the range of from about 20 to about 30 pounds of said hydrocarbon oil per 100 pounds of said composition.

2. The composition of claim 1 wherein the particle size of said particulate polyvinyl chloride in said composition is in the range of from about 5 to about 10 microns.

3. The composition of claim 2 wherein said hydrocarbon oil is API GL-6 gear oil whose SAE viscosity is 85W-140.

4. The composition of claim 3 wherein said glyceride is rendered animal fat.

5. The composition of claim 4 wherein said rendered animal fat is lard.

6. The composition of claim 5 wherein said weight ratio of said polyvinyl chloride to said gear oil in said composition is an amount in the range of from about 1.25 to about 2 parts by weight of said polyvinyl chloride per 1 part by weight of said gear oil and said weight ratio of said lard to said gear oil in said composition is an amount in the range of from about 0.75 to about 1.5 parts by weight of said lard per 1 part by weight of said gear oil.

7. A composition of matter comprising a uniform blend of a dispersion of particulate polyvinyl chloride in a plasticizer for said polyvinyl chloride, a glyceride, selected from the group consisting of rendered animal fat, vegetable oil and mixtures thereof, and a hydrocarbon oil;

wherein the particle size of said particulate polyvinyl chloride in said dispersion is in the range of from about 5 to about 10 microns, and said dispersion is comprised of 100 parts by weight of said polyvinyl chloride and 30 parts by weight of said plasticizer;

the weight ratio of said dispersion of said polyvinyl chloride to said hydrocarbon oil in said composition is an amount in the range of from about 1.3 to about 3.25 parts by weight of said dispersion of said polyvinyl chloride per 1 part by weight of said hydrocarbon oil;

the weight ratio of said glyceride to said hydrocarbon oil in said composition is an amount in the range of from about 0.5 to about 2 parts by weight of said glyceride per 1 part by weight of said hydrocarbon oil; and said hydrocarbon oil is present in said composition in an amount in the range of from about 20 to about 30 pounds of said hydrocarbon oil per 100 pounds of said composition.

8. The composition of claim 7 wherein said plasticizer is an ester of phthalic acid.

9. The composition of claim 8 wherein said hydrocarbon oil is API GL-6 gear oil whose SAE viscosity is 85W-140.

10. The composition of claim 9 wherein said glyceride is rendered animal fat.

11. The composition of claim 10 wherein said rendered animal fat is lard.

12. The composition of claim 11 wherein said weight ratio of said dispersion of said polyvinyl chloride to said gear oil in said composition is an amount in the range of from about 2 parts by weight of said dispersion of said polyvinyl chloride per 1 part by weight of said gear oil and said weight ratio of said lard to said gear oil in said composition is an amount in the range of from about 1 part by weight of said lard per 1 part by weight of said gear oil.

13. The composition of claim 12 wherein said composition is a stable, non-staining, solid-in-liquid emulsion at temperatures in the range of from about 60 to about 212° F. having a density of about 1.255 grams per milliliter and a Brookfield viscosity greater than 4000 cp at 78° F.

14. A method of cutting threads on the interior surface of a linear hole in a metal workpiece, said method comprising providing a linear rod having a circular cross section and spiral grooves formed on the exterior surface thereof wherein the major diameter of said linear rod is greater than the bore diameter of said hole in said workpiece, causing said rod to rotate, inserting said rotating rod into said hole in the presence of a lubricating medium whereby said grooves on said rod contact said interior surface of said hole to thereby cut said threads, said lubricating medium is a composition of matter comprised of a uniform blend of a particulate polyvinyl chloride, a glyceride, selected from the group consisting of rendered animal fat, vegetable oil and mixtures thereof, and a hydrocarbon oil;

wherein the weight ratio of said polyvinyl chloride to said hydrocarbon oil in said composition is an amount in the range of from about 1 to about 2.5 parts by weight of said polyvinyl chloride per 1 part by weight of said hydrocarbon oil;

the weight ratio of said glyceride to said hydrocarbon oil in said composition is an amount in the range of from about 0.5 to about 2 parts by weight of said glyceride per 1 part by weight of said hydrocarbon oil; and said hydrocarbon oil is present in said composition in an amount in the range of from about 20 to about 30 pounds of said hydrocarbon oil per 100 pounds of said composition.

15. The method of claim 14 wherein the particle size of said particulate polyvinyl chloride in said composition is in the range of from about 5 to about 10 microns.

16. The method of claim 15 wherein said hydrocarbon oil is API GL-6 gear oil whose SAE viscosity is 85W-140.

17. The method of claim 16 wherein said glyceride is rendered animal fat.

18. The method of claim 17 wherein said rendered animal fat is lard.

19. The method of claim 18 wherein said weight ratio of said polyvinyl chloride to said gear oil in said composition is an amount in the range of from about 1.35 to about 1.92 parts by weight of said polyvinyl chloride per 1 part by weight of said gear oil and said weight ratio of said lard to said gear oil in said composition is an amount in the range of from about from about 0.875 to about 1.25 parts by weight of said lard per 1 part by weight of said gear oil.

20. A method of making a composition of matter comprised of a uniform blend of a particulate polyvinyl chloride, a glyceride, selected from the group consisting of rendered animal fat, vegetable oil and mixtures thereof, and a hydrocarbon oil, said method being comprised of the steps of:

introducing into a mixing vessel the quantity of said hydrocarbon oil required in said composition and commencing agitation of said oil;

adding to said hydrocarbon oil in said mixing vessel the quantity of said particulate polyvinyl chloride required in said composition while continuing said agitation to form a uniform blend of said oil and said particulate polyvinyl chloride;

adding to said uniform blend of said oil and said particulate polyvinyl chloride in said mixing vessel the quantity of said glyceride required in said composition while continuing said agitation to form a uniform blend of said oil, said particulate polyvinyl chloride and said glyceride to thereby make said composition;

wherein said hydrocarbon oil is introduced into said mixing vessel in an amount in the range of from about 20 to about 30 pounds of said hydrocarbon oil per 100 pounds of said composition, said particulate polyvinyl chloride, having a particle size in the range of from about 5 to about 10 microns, is added to said mixing vessel as a dispersion comprised of 100 pounds of polyvinyl chloride in 30 pounds of phthalate plasticizer in an amount in the range of from about 1.75 to about 2.5 pounds dispersion per pound of said hydrocarbon oil, and said glyceride is added to said mixing vessel in an amount in the range of from about 0.875 to about 1.25 pounds glyceride per pound of said hydrocarbon oil and.

21. The method of claim 20 wherein said hydrocarbon oil is API GL-6 gear oil whose SAE viscosity is 85W-140 and said glyceride is lard.

22. The method of claim 21 wherein said dispersion is added to said mixing vessel in an amount of about 2 pounds dispersion per pound of said gear oil and said lard is added to said mixing vessel in an amount of about 1 pound lard per pound of said gear oil.

23. The product of the process of claim 20.

24. The product of the process of claim 21.

25. The product of the process of claim 22.

* * * * *